US005288228A

United States Patent [19]

Fujita et al.

[11] Patent Number: 5,288,228

[45] Date of Patent: Feb. 22, 1994

[54] HEAT-RESISTANT MATERIALS

[75] Inventors: Hideo Fujita, Hirakata; Jun Funakoshi, Suita; Takahiro Kaba, Higashiosaka; Akira Shinosaki; Hiroyuki Araragi, both of Hirakata, all of Japan

[73] Assignee: Kubota Corporation, Osaka, Japan

[21] Appl. No.: 941,882

[22] Filed: Sep. 8, 1992

Related U.S. Application Data

[63] Continuation of Ser. No. 767,753, Sep. 30, 1991, abandoned, which is a continuation of Ser. No. 589,559, Sep. 28, 1990, abandoned.

[30] Foreign Application Priority Data

Nov. 17, 1989 [JP] Japan ..... 1-300091

[51] Int. Cl.[5] ..... F27D 3/02

[52] U.S. Cl. ..... 432/234; 432/236; 432/243

[58] Field of Search ..... 432/234, 235, 236

[56] References Cited

U.S. PATENT DOCUMENTS

| | | | |
|---|---|---|---|
| 1,357,550 | 11/1920 | Fahrenwald . | |
| 2,473,020 | 6/1949 | Eramus | 420/428 |
| 2,780,545 | 2/1957 | Blank | 420/420 |
| 2,823,988 | 2/1958 | Grant | 75/951 |
| 2,834,666 | 5/1958 | Bergh | 420/428 |
| 2,946,676 | 7/1960 | Brennan | 420/428 |
| 3,017,265 | 1/1962 | McGurty | 75/126 |
| 3,728,088 | 4/1973 | Benjamin | 75/951 |
| 3,746,584 | 7/1973 | Takeda et al. . | |
| 3,816,111 | 6/1974 | Schneider . | |
| 4,386,630 | 6/1983 | Gapinski | 432/234 |
| 4,442,067 | 4/1984 | Saito | 420/428 |
| 4,601,659 | 7/1986 | Webster et al. | 432/234 |
| 4,689,009 | 8/1987 | Heuss | 432/234 |
| 4,747,775 | 5/1988 | Takagi et al. | 432/243 |
| 4,900,248 | 2/1990 | Terai et al. | 432/236 |
| 4,906,525 | 3/1990 | Seguchi et al. | 432/234 |
| 5,136,610 | 8/1992 | Heuss | 432/236 |

FOREIGN PATENT DOCUMENTS

| | | |
|---|---|---|
| 11089 | 2/1923 | Australia . |
| 11807 | 2/1923 | Australia . |
| 107293 | 7/1938 | Australia . |
| 117040 | 8/1942 | Australia . |
| 144935 | 11/1948 | Australia . |
| 229402 | 12/1958 | Australia . |
| 277794 | 8/1964 | Australia . |
| 435979 | 9/1970 | Australia . |
| 490158 | 10/1976 | Australia . |
| 492333 | 10/1976 | Australia . |
| 1608116 | 12/1970 | Fed. Rep. of Germany . |
| 1608109 | 6/1971 | Fed. Rep. of Germany . |
| 2003192 | 7/1971 | Fed. Rep. of Germany . |
| 2107362 | 9/1971 | Fed. Rep. of Germany . |
| 2137793 | 12/1972 | France . |
| 48-102023 | 12/1973 | Japan . |
| 53-147615 | 12/1978 | Japan . |
| 54-43813 | 4/1979 | Japan . |
| 55-31129 | 3/1980 | Japan . |
| 56-122662 | 9/1981 | Japan . |
| 59-162219 | 9/1984 | Japan . |
| 63-4037 | 1/1988 | Japan . |
| 63-199844 | 8/1988 | Japan . |

OTHER PUBLICATIONS

"The Making, Shaping and Treating of Steel", *United States Steel*, 8th Ed., p. 227 (Sep. 1965).

Metal Handbook, *Amer. Soc. Metals*, 8, (1973).

Metal Handboo *Amer. Soc. Metals*, pp. 399–406 (1948).

*A Dictionary of Metallurgy*, pp. 90, 114–115 (1958).

*Primary Examiner*—Henry C. Yuen

*Attorney, Agent, or Firm*—Armstrong, Westerman, Hattori, McLeland & Naughton

[57] ABSTRACT

A heat-resistant material having excellent high-temperature strength and high oxidation resistance at temperatures exceeding 1300° C. The material is a heat-resistant Cr-Fe alloy including at least 60% of Cr and at least 5% of Fe, and having a mean grain size of at least 50 μm and having a melting point of at least 1600 ° C., or a composite material composed of the said heat-resistant alloy serving as a metal matrix and a ceramic, and containing up to 40% by volume of a dispersed ceramic phase in the metal matrix.

7 Claims, 4 Drawing Sheets

HEAT-RESISTANT MATERIALS

This is a continuation of application Ser. No. 07/767,753, filed Sep. 30, 1991, now abandoned, which is a continuation of application Ser. No. 07/589,559 filed Sep. 28, 1990, now abandoned.

FIELD OF THE INVENTION

The present invention relates to heat-resistant materials suitable for use in heating furnaces, especially in heating furnaces of the walking beam type.

BACKGROUND OF THE INVENTION

Heating furnaces of the walking beam type are used in the hot rolling process for heating steel materials such as steel pieces or slabs. These furnaces are equipped with skid beams in a plurality of rows for supporting and transporting steel pieces, slabs or like materials to be heated. These skid beams include movable beams and fixed beams. The movable beams periodically repeat an upward and downward movement and a horizontal reciprocating movement, whereby the material to be heated is transported while being transferred to the movable beam and the fixed beam alternately.

FIG. 1 shows a skid beam 1 which comprises a hollow skid pipe 10 provided on the top of its periphery with a plurality of skid buttons 12 arranged axially thereof at a specified spacing. A refractory lining 5 covers the outer peripheral surface of the skid pipe 10 and the base to upper portion of each skid button 12 for use in the interior of the heating furnace. The skid button 12 is a block in the form of a truncated cone, truncated pyramid or the like to support on the top thereof the material 3 to be heated.

Materials heretofore used for skid buttons are heat-resistant alloy steels such as high Ni high Cr alloy steels and high Co alloy steels (e.g., 50 Co—20 Ni—Fe steel).

Cooling water is forcibly passed through the skid pipe to diminish the thermal influence of the high-temperature oxidizing internal atmosphere of the furnace on the skid button and to a the rise in the temperature of the skid button. This assures the skid button of strength capable of withstanding the load of the material to be heated and protects the surface of the skid button from oxidation damage.

However, if the cooling action of the cooling water flowing through the skid pipe is insufficient, the skid button is subject, for example, to deformation or oxidation damage. On the other hand, the cooling action, if excessive, entails the problem that the material to be heated and supported on the top of the skid button is locally cooled by contact with the skid button, which produces a so-called skid mark and permits uneven heating of the material.

Especially recently, it has become common practice to operate heating furnaces at temperatures exceeding 1300° C. to achieve higher operation efficiencies. For operation at such high temperatures, the skid button must be forcibly cooled more effectively so as to be protected from a reduction in strength and increase in oxidation damage. Nevertheless, an enhanced cooling action increases the temperature difference between the interior of the furnace and the skid button, not only aggravating uneven heating of the material as stated above but also entailing a greater heat loss.

Accordingly, skid buttons of conventional heat-resistant alloy have the problem of failing to withstand high operating temperatures and undergoing deformation due to the load of the material to be heated or oxidation damage or the like. Although it has been attempted to use sintered ceramic bodies as skid buttons, ceramics are brittle materials, are therefore liable to crack or chip, and are not usable with good stability.

The present invention has been accomplished in view of the above problems.

SUMMARY OF THE INVENTION

An object of the present invention is to provide a heat-resistant material capable of exhibiting excellent strength and high resistance to oxidation at high temperatures in excess of 1300° C.

Another object of the present invention is to provide a skid button capable of exhibiting excellent high-temperature strength and high resistance to oxidation for operation at high temperatures in excess of 1300° C. even if the cooling action of the skid pipe is not enhanced greatly.

The present invention provides a heat-resistant material which is a heat-resistant alloy comprising at least 60% (by weight, the same as hereinafter) of Cr, and the balance substantially Fe (which, however, is present in an amount of at least 5%), the heat-resistant alloy having a mean grain size in its alloy structure of at least 50 μm and melting point of at least 1600° C.

The present invention further provides a heat-resistant material which is a composite material composed of an alloy and a ceramic, the alloy being in the form of a metal matrix and comprising at least 60% of Cr, and the balance substantially Fe (which, however, is present in an amount of at least 5%), the alloy having a mean grain size in its alloy structure of at least 50 μm and a melting point of at least 1600° C., the composite material containing up to 40% by volume of a dispersed ceramic phase present in the metal matrix.

DESCRIPTION OF THE PREFERRED EMBODIMENTS

Figure 1:
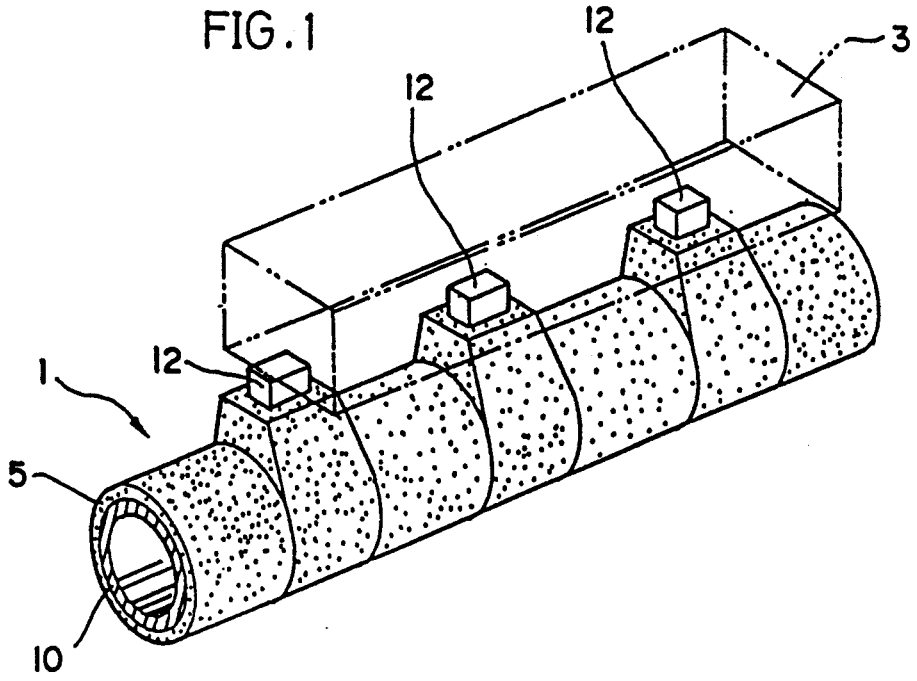
FIG. 1 is a perspective view of a skid beam for use in heating furnaces of the walking beam type.

First, a heat-resistant material of the invention will be described which is a heat-resistant alloy.

The heat-resistant alloy of the present invention contains at least 60% of Cr. The Cr content should be at least 60% to ensure a melting point of at least 1600° C. and to obtain stable resistance to oxidation for use at high temperatures in excess of 1300° C. The melting point of at least 1600° C. is a prerequisite for giving excellent high-temperature strength.

The heat-resistant alloy of the invention contains at least 5% of Fe. The Fe content of at least 5% renders the alloy composition amenable to sintering and permits use of moderate sintering conditions when the alloy composition is to be sintered into an alloy while serving to moderate the thermal conditions for melting and casting operations when the composition is to be cast into an alloy. These effects are not available if the content is less than 5%.

The heat-resistant alloy of the invention has a Cr—Fe composition comprising at least 60% of Cr, and the balance substantially Fe (which, however, should be present in an amount of at least 5%). When required, the alloy may further comprise at least one element selected from the group consisting of up to 10% of W, up to 10% of Mo, up to 10% of Nb, up to 10% of Ta, up to 10% of Hf, up to 10% of Co, up to 10% of Ni, up to 10% of Ti, up to 10% of Al, up to 10% of V, up to 10% of Mn and up to 10% of a rare-earth element, in a combined amount of up to 35%, preferably up to 30%.

These elements are added as required because such elements have a solid solution strengthening effect or act to strengthen the alloy by particle or fiber dispersion, affording further improved high-temperature strength. Furthermore, intermetallic compounds (such as $Cr_2Nb$, $Cr_2Zr$, $Cr_2Ta$ and $Cr_2Ti$) then formed serve to strengthen the alloy more effectively by particle or fiber dispersion to give still improved alloy strength.

Al or rare-earth elements (such as Y and Sc) are expected to produce further improved resistance to oxidation in addition to an alloy strengthening effect.

However, the presence of excessive amounts of the above elements is likely to lower the melting point of the alloy below 1600° C. and to impair the workability thereof, so that the upper limit of the combined amount should be 35%, preferably 30%.

The heat-resistant alloy is allowed to contain P, S and other impurities insofar as such impurities are inevitably incorporated into the alloy by usual alloy preparation techniques. Further up to 0.8% of C and up to 5% of Si are allowed to be present in the alloy.

Next, a composite material composed of an alloy and a ceramic will be described.

With the heat-resistant material of the present invention, up to about 40% by volume of a ceramic can be present as a dispersed phase in the above heat-resistant alloy when so required.

Examples of ceramics which can be present as dispersed in the alloy are oxides such as $Cr_2O_3$, $Al_2O_3$, $SiO_2$, $Y_2O_3$, LaO and $Sc_2O_3$, nitrides such as $Si_3N_4$, TiN, BN and AlN, carbides such as $B_4C$, $Cr_3C_2$, WC and SiC, silicides such as $Mo_2Si$ and $Cr_2Si$, and borides such as $CrB_2$ and $TiB_2$. The presence of at least one of these ceramics produces a particle dispersion strengthening effect or fiber dispersion strengthening effect, which gives further improved high-temperature strength to the alloy. Incidentally, even if the material contains over about 40% by volume of ceramics, the effect will level off; the material rather becomes brittle. Accordingly, the upper limit of the amount of ceramic(s) to be present should be about 40% by volume.

As already stated, the heat-resistant alloy or the heat-resistant material of the present invention must be not only at least 1600° C. in melting point but also at least 50 μm in the mean grain size of the alloy structure.

The crystal grains must be at least 50 μm in means size to give sufficient strength, especially satisfactory resistance to compressive deformation, in atmospheres having a high temperature in excess of 1300° C.

While the heat-resistant alloy or material of the present invention can be prepared by sintering, melt casting or other process, the crystal structure must be at least 50 μm in mean size regardless of the process resorted to.

When sintering is resorted to, it is desirable to employ the hot isostatic press sintering process in view of the homogeneity and compactness of the sintered alloy obtained. This process can be practiced, for example, by heating the starting composition at a temperature of about 1000 to about 1500° C. under a pressure of about 1000 to about 2000 kgf/cm$^2$ for about 2 to about 5 hours. The grain size of the sintered alloy is dependent on the particle size of the powdery starting composition. We have found that when the starting composition is at least about 200 μm in mean particle size, the sintered alloy can be given a mean grain size of at least 50 μm.

When a ceramic is to be made present in the alloy as a dispersed phase, the ceramic is used conjointly with the powdery starting alloy composition. The ceramic can be of any desired size. Useful particulate ceramics are, for example, about 0.1 to about 10 μm in particle size. Examples of fibrous ceramics usable are about 1 to about 1000 μm in fiber length and about 10 to about 50 in aspect ratio.

When the present alloy is to be prepared by casting, for example, a high-frequency melting furnace is usable. The ceramic can be incorporated into the alloy as a dispersed phase by adding the ceramic as finely divided to the alloy in a molten state before the melt is poured into a mold or to the molten alloy as placed in the mold, and solidifying the mixture with the solid uniformly mixed with the melt.

The grain size of the alloy to be cast is adjustable with ease by controlling the solidification velocity of the mixture within the mold. For example, a sufficiently coarse crystal grain structure can be obtained by decreasing the solidification velocity with use of a sand mold, refractory mold or the like.

When required, the heat-resistant alloy or material obtained by sintering or casting can be heat-treated for the adjustment of the grain size.

EXPERIMENTAL EXAMPLES

The specimens each having the composition and grain size listed in Table 1 were tested for high temperature compressive deformation and for high temperature oxidation.

The mean grain size was determined by the following method. Five areas as desired were selected from the microstructure of the specimen and photomicrograpbs (×50) was taken at each of the selected areas. Two vertical lines and two horizontal lines were drawn over each of the field of views, and the number of crystal grains were counted up. The total length of the lines was divided by the number of crystal grains to obtain a value as a mean of grain sizes. The average of the mean values for the five view fields was calculated as the mean grain size.

TABLE 1

| Specimen No. | Chemical Composition (wt %) Cr | C | Si | W | Mo | Al | Ni | Co | Fe | Ceramic (by vol.) (%) | Alloy melting point (°C.) | Mean grain size (μm) | Remarks |
|---|---|---|---|---|---|---|---|---|---|---|---|---|---|
| 1 | 89.2 | 0.02 | 1.5 | — | — | — | — | — | Bal. | — | 1710 | 100 | sintered |
| 2 | 89.2 | 0.02 | 1.5 | — | — | — | — | — | Bal. | — | 1710 | 50 | sintered |
| 3 | 89.2 | 0.02 | 1.5 | — | — | — | — | — | Bal. | — | 1710 | 180 | sintered |
| 4 | 89.2 | 0.02 | 1.5 | — | — | — | — | — | Bal. | — | 1710 | 15 | sintered |
| 5 | 84.5 | 0.02 | 2.5 | — | — | — | — | — | Bal. | — | 1680 | 200 | cast |
| 6 | 85.0 | 0.02 | 1.5 | — | — | — | — | — | Bal. | 15.0 | 1690 | 150 | sintered |
| 7 | 83.0 | 0.02 | 1.0 | 5.0 | 5.0 | — | — | — | Bal. | — | 1670 | 190 | sintered |
| 8 | 85.5 | 0.02 | 1.0 | — | — | 5.0 | — | — | Bal. | — | 1690 | 140 | sintered |
| 9 | 83.0 | 0.02 | 1.0 | 5.0 | — | — | — | — | Bal. | 10.0 | 1670 | 130 | sintered |
| 10 | 27.1 | — | — | — | — | — | 19.8 | 40.4 | Bal. | — | 1380 | 300 | cast |
| 11 | 58.5 | 0.02 | 2.4 | — | — | — | — | — | Bal. | — | 1570 | 250 | cast |

High-Temperature Compressive Deformation Test

Figure 8:
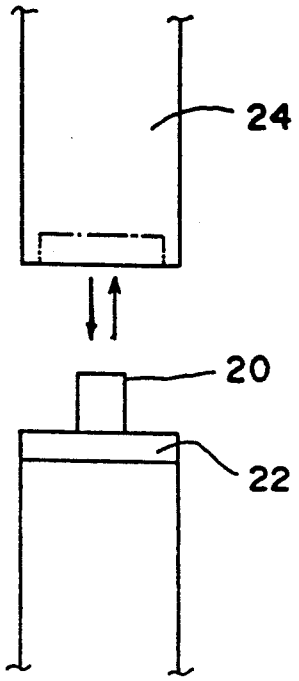
FIG. 8 is a diagram illustrating the high-temperature compressive deformation test.
Figure 9:
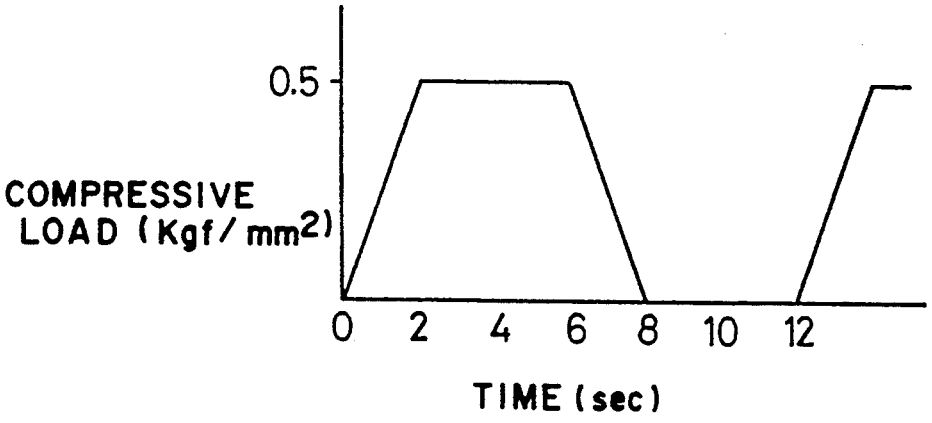
FIG. 9 is a diagram illustrating repeated loading cycles in the high-temperature compressive deformation test.

A solid cylindrical test piece (30 mm in diameter and 50 mm in length) was cut out from each specimen and placed into a furnace at 1350° C. As shown in FIG. 8, the test piece 20 was fixedly placed upright on a fixed base 22, and a ram 24 above the test piece was moved up and down to repeatedly apply a compression load of 0.5 kgf/mm$^2$ to the test piece. FIG. 9 shows a 12-second loading cycle comprising 4 seconds for the application of the compression load of 0.5 kgf/mm$^2$, 4 seconds for allowing the test piece to stand free of the load, 2 seconds as a loading transition period and 2 seconds as an unloading transition period. This cycle was repeated 10000 times.

The amount of plastic deformation, D (%), due to compression was calculated from the following equation.

$$D(\%)=(Lo-L)/Lo\times 100$$

where Lo is the length of the test piece before testing, and L is the length thereof after testing.

High-Temperature Oxidation Test

A solid cylindrical test piece (8 mm in diameter and 40 mm in length) was cut out from each specimen and held in a heating furnace (with air as atmosphere) at 1350° C. for 100 hours. The test piece was then withdrawn from the furnace, scales were removed from the surface of the test piece with an alkali solution and an acid solution, and the oxidation loss (g/m$^2$hr) was determined from the resulting change in the weight of the test piece.

Table 2 shows the results of the high-temperature compressive deformation test and the high-temperature oxidation test.

TABLE 2

| Specimen No. | Amount of compressive deformation, D (%) | Oxidation loss (g/m$^2$ hr) |
|---|---|---|
| 1 | 0.5 | 4.2 |
| 2 | 1.25 | 4.1 |
| 3 | 0.38 | 3.8 |
| 4 | 3.0 | 3.9 |
| 5 | 0.25 | 3.9 |
| 6 | 0.40 | 3.5 |
| 7 | 0.35 | 5.5 |
| 8 | 0.45 | 3.2 |
| 9 | 0.30 | 5.0 |
| 10 | 4.3 | 67.0 |
| 11 | 3.5 | 4.5 |

With reference to Table 1, specimens No. 1 to No. 3 and No. 5 to No. 9 are examples of heat-resistant materials of the invention. Specimens No. 4 and No. 11 are comparative examples; with the former, the mean grain size is outside the range of the invention, and with the latter, the Cr content is outside the range of the invention. Specimen No. 10 is Co—Ni—Cr alloy heretofore used for skid buttons.

Specimen No. 4 is great in compressive deformation at a high temperature presumably because it is small in mean grain size. Specimen No. 11 is also great in compressive deformation at a high temperature. This appears attributable to a low Cr content and low melting point.

Specimen No. 10 is very low in melting point, great in compressive deformation and inferior in oxidation resistance.

In contrast, it is seen that heat-resistant alloys or materials of the invention are very excellent in high-temperature strength and oxidation resistance.

To further clarify the difference between the heat-resistant alloy of the invention and the conventional heat-resistant alloy in resistance to compressive deformation and to oxidation at high temperatures, specimens No. 2 and No. 10 were subjected to more detailed comparative experiments.

Figure 3:
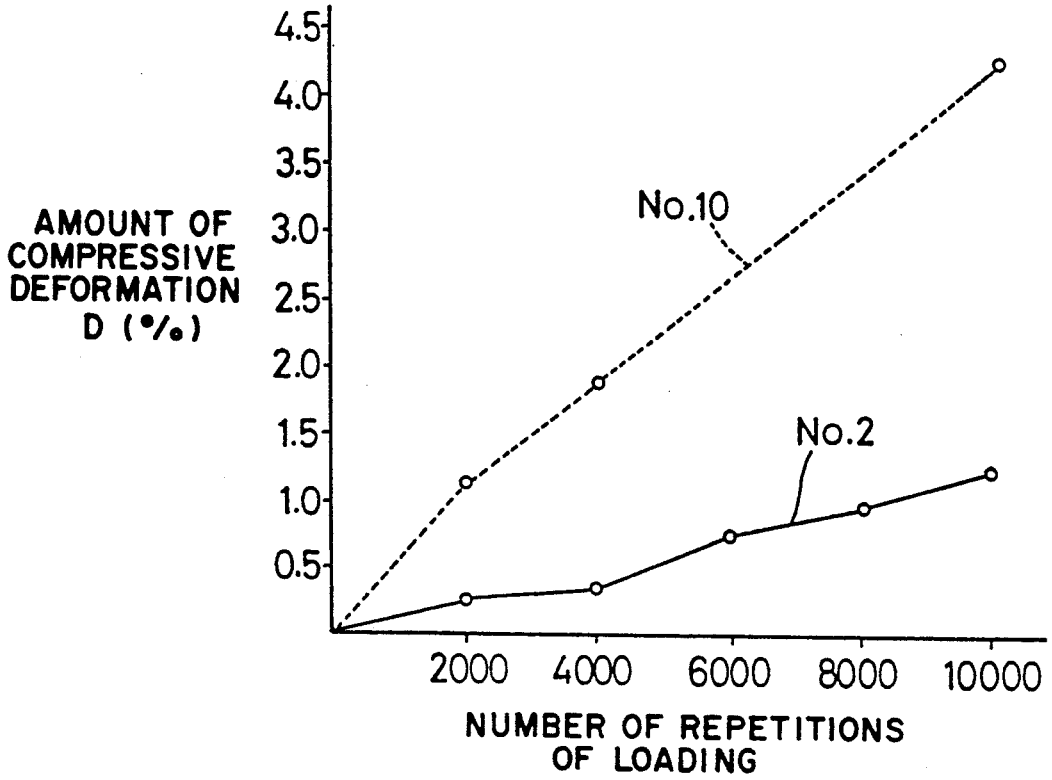
FIG. 3 is a graph showing the relationship between the number of repetitions of loading and the variation in the amount of compressive deformation, as determined by a high temperature compressive deformation test.

FIG. 3 shows the relationship between the number of repetitions of compression load application and the variation in the amount of compressive deformation as determined by a high-temperature compression test.

Figure 4:
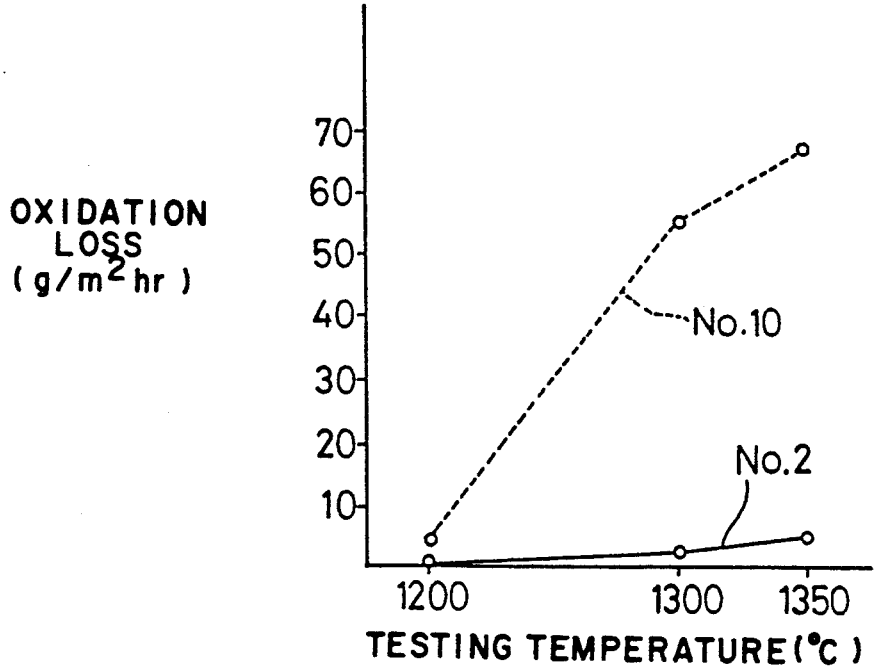
FIG. 4 is a graph showing the relationship between the heating temperature and the oxidation loss as established by a high-temperature oxidation test.

FIG. 4 shows the relationship between the heating temperature and the oxidation loss as established by a high-temperature oxidation test. The specimens were tested for 100 hours at each of varying temperatures.

The results given in FIGS. 3 and 4 reveal that the greater the number of repetitions of compression load application and the higher the testing temperature, the more remarkable is the difference between the alloy of the invention and the conventional alloy.

Figure 5:
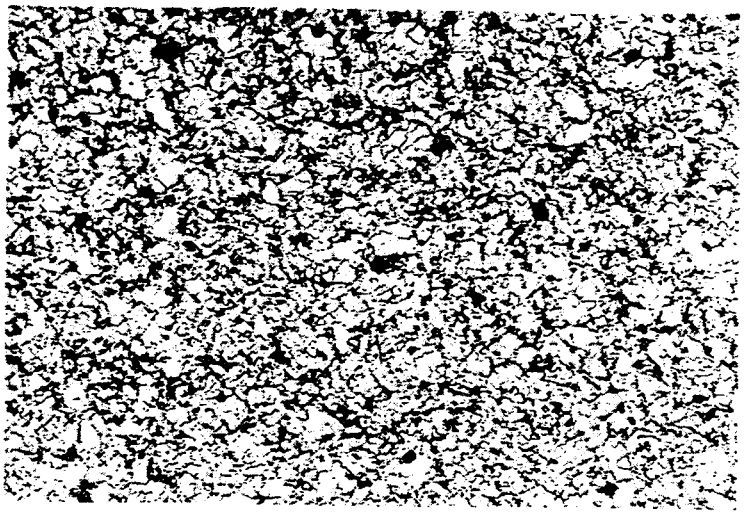
FIGS. 5 to 7 are photomicrographs (at a magnification of ×50) showing the metal structures of specimens No. 2, No. 5 and No. 4, respectively.
Figure 6:
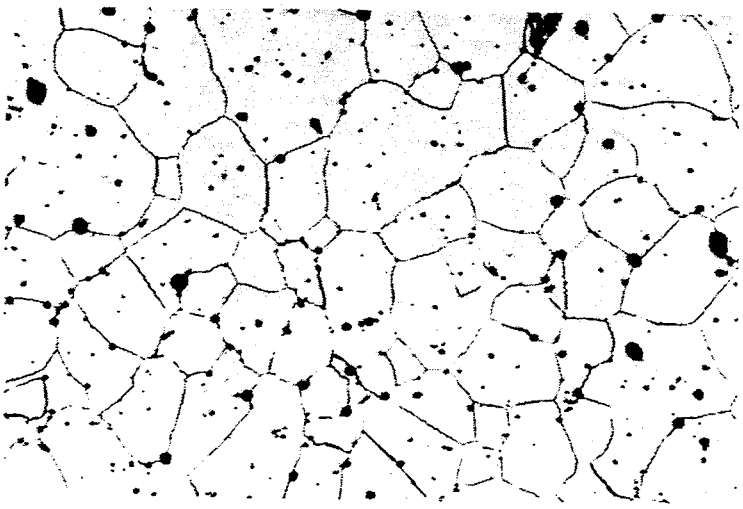
Figure 7:
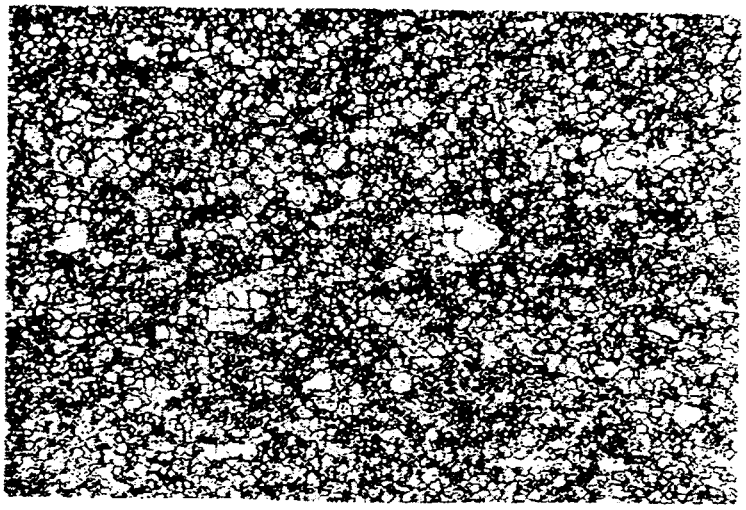

For reference, FIGS. 5 to 7 show the relationship between crystal grains and microstructure. The photomicrographs (at a magnification of ×50) of specimen No. 2 (50 μm in mean grain size), specimen No. 5 (200 μm in mean grain size) and specimen No. 4 (15 μm in mean grain size) are shown in FIGS. 5, 6 and 7, respectively.

Figure 2:
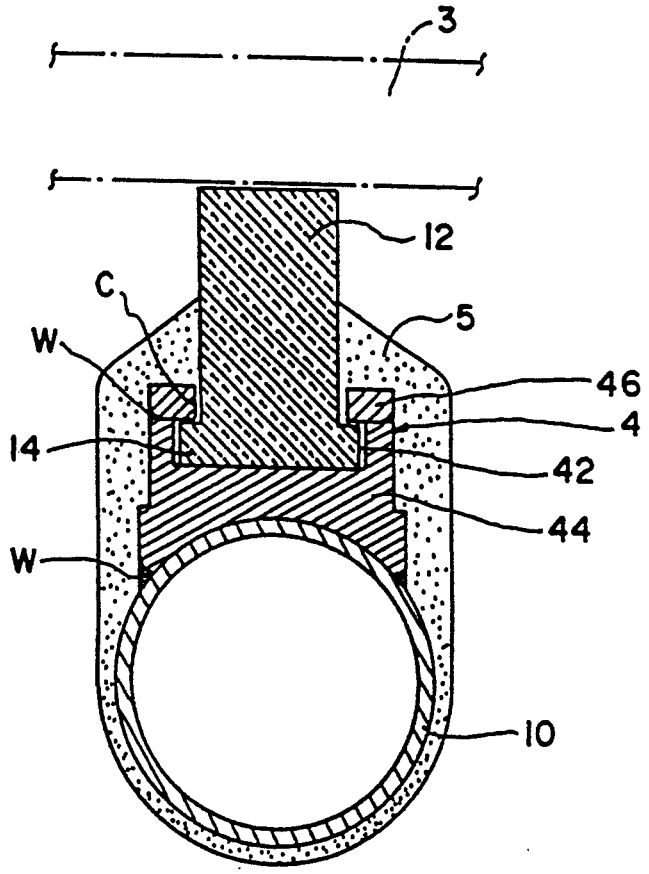
FIG. 2 is a sectional view showing a structure for fixing a skid button made of a heat-resistant material of the invention.

Skid buttons were prepared from the heat-resistant alloy or material of the present invention and attached to a skid pipe by support members as seen in FIG. 2. The illustrated embodiment is adapted to prevent scales separating off the surface of the material heated from wedging into the support members and to preclude the skid buttons from chipping, cracking and like faults by giving consideration to the difference in the amount of thermal expansion due to the difference in material between the skid buttons and the support members.

The skid button 12 shown in FIG. 2 is in the form of a truncated cone and has a flange 14 at its bottom. The skid button 12 can be in the form of a solid cylinder, truncated pyramid or the like.

A support member 4 comprises a seat portion 44 formed with an annular cavity 42 for the flange 14 of the skid button 12 to fit in loosely, and a ring member 46 having an inside diameter slightly larger than the outside diameter of the shank of the skid button 12. The bottom of the seat portion 44 is secured to a skid pipe 10 as by a weld W. With the skid button 12 fitted in the annular cavity 42, the ring member 46 is secured to the seat portion 44 as by a weld W, whereby the skid button 12 is held to the support member 4.

The outer periphery of the skid pipe 10 and the base to upper portion of the support member 4 are covered with a refractory layer 5 and are thereby protected from the high-temperature oxidizing atmosphere within the furnace. The refractory of the layer 5 fills the clearance C between the skid button 12 and the ring member 46, so that the scales separating off a material 3 heated and placed on the skid button 12 are prevented from falling into the clearance C. Consequently, the ring member 46 is prevented from deformation due to the ingress of scales.

Preferably, the skid button 12 is about 100 to about 200 mm in height. The height of the skid button 12 projecting upward beyond the ring member 46 of the support member 4 is preferably about 50 to about 100 mm.

The heat-resistant alloy or heat-resistant material of the present invention is excellent in high-temperature strength and in resistance to oxidation, and these excellent characteristics are in no way available with high Co alloy steels and like materials heretofore used. Accordingly, the skid buttons prepared from the heat-resistant alloy or material of the invention exhibit sufficient durability even under such high-temperature operating conditions as employed recently, diminishing the maintenance effort and thereby contributing a great deal to improvements in operation efficiency.

Furthermore, the excellent high-temperature characteristics of the present material serve to moderate the cooling conditions for the cooling water to be passed through the skid pipe. This reduces the likelihood of occurrence of skid marks on the material to be heated and achieves uniform heating for the production of materials of improved quality.

The heat-resistant alloy or heat-resistant material of the present invention, which is well-suited for skid buttons for use in heating furnaces of the walking beam type, is not limited to such use but is of course usable for applications where resistance to compressive deformation and to oxidation at high temperature is essential.

What is claimed is:

1. An assembly of a skid button and a support member therefor, said assembly being adapted for use in heating furnaces and comprising:

a skid button having a shank and a flange at its base portion;

a support member including a seat portion weldable to a skid pipe and formed with an annular cavity for the flange of the skid button to fit in loosely, and a ring member to be secured to the seat portion and having an inside diameter slightly larger than an outside diameter of the shank of the skid button, and a refractory layer which covers at least the base and lower portion of the shank of said skid button.

2. The assembly of claim 1, wherein said skid button is made of an alloy consisting essentially of, in % by weight, at least 60% of Cr, and the balance being substantially Fe, said alloy containing at least 5% of Fe and having a mean grain size of at least 50 μm and a melting point of at least 1600° C.

3. The assembly of claim 2, wherein said alloy includes at least one element selected from the group consisting of C and Si, such that a maximum amount of C is 0.8% and C maximum amount of Si is 5%.

4. The assembly of claim 2, wherein said alloy includes at least one element selected from the group consisting of W, Mo, Nb, Ta, Hf, Co, Ni, Ti, Al, V, Mn, and a rare-earth element, such that a maximum amount of each element is 10% and a maximum combined amount of two or more elements is 35%.

5. The assembly of claim 1, wherein said skid button is formed by sintering a material having a composite structure comprising a dispersed ceramic phase and a metal matrix, wherein said dispersed ceramic phase has a maximum concentration of 40% by volume, said metal matrix consisting essentially of, in % by weight, at least 60% of Cr, and the balance being substantially Fe, said metal matrix containing at least %% of Fe and having a mean grain size of at least 50 μm and a melting point of at least 1600° C.

6. The assembly of claim 5, wherein said metal matrix includes at least one element selected from the group consisting of C and Si, such that a maximum amount of C is 0.8% and C maximum amount of Si is 5%.

7. The assembly of claim 5, wherein said metal matrix includes at least one element selected from the group consisting of W, Mo, Nb, Ta, Hf, Co, Ni, Ti, Al, V, Mn, and a rare-earth element such that a maximum amount of each element is 10% and a maximum combined amount of two or more elements is 35%.

* * * * *